US010617279B2

(12) United States Patent
Liu et al.

(10) Patent No.: US 10,617,279 B2
(45) Date of Patent: Apr. 14, 2020

(54) SPRAY ARM ASSEMBLY FOR DISHWASHER AND DISHWASHER HAVING SAME

(71) Applicant: FOSHAN SHUNDE MIDEA WASHING APPLIANCES MFG. CO., LTD., Foshan (CN)

(72) Inventors: Dianling Liu, Foshan (CN); Feng Gao, Foshan (CN)

(73) Assignee: FOSHAN SHUNDE MIDEA WASHING APPLIANCES MFG. CO., LTD., Foshan (CN)

( * ) Notice: Subject to any disclaimer, the term of this patent is extended or adjusted under 35 U.S.C. 154(b) by 345 days.

(21) Appl. No.: 15/788,664

(22) Filed: Oct. 19, 2017

(65) Prior Publication Data

US 2018/0035863 A1 Feb. 8, 2018

Related U.S. Application Data

(63) Continuation of application No. PCT/CN2016/070045, filed on Jan. 4, 2016.

(30) Foreign Application Priority Data

Apr. 22, 2015 (CN) ..... 2015 1 0194201
Apr. 22, 2015 (CN) ..... 2015 2 0247198 U

(51) Int. Cl.
*A47L 15/23* (2006.01)
*A47L 15/42* (2006.01)

(52) U.S. Cl.
CPC ..... *A47L 15/23* (2013.01); *A47L 15/4282* (2013.01)

(58) Field of Classification Search
CPC ..... A47L 15/23; A47L 15/4282; A47L 15/22; A47L 2501/20

(Continued)

(56) References Cited

U.S. PATENT DOCUMENTS 3,361,361 A * 1/1968 Schutte ..... A47L 15/23 239/227
7,980,260 B2 * 7/2011 Bertsch ..... A47L 15/22 134/180

(Continued)

FOREIGN PATENT DOCUMENTS

CN 201987512 U 9/2011
CN 103190873 A 7/2013

(Continued)

OTHER PUBLICATIONS

Gao et al., "Sprinkle Arm for Dishwasher", Dec. 2014, CN 203987928—Machine Translation (Year: 2014).*

(Continued)

*Primary Examiner* — David G Cormier
*Assistant Examiner* — Thomas Bucci
(74) *Attorney, Agent, or Firm* — Morgan, Lewis & Bockius LLP

(57) ABSTRACT

Disclosed are a spraying arm assembly (100) for a dishwasher and a dishwasher having same. The spraying arm assembly (100) includes: a fixing seat (110), a first bevel gear (111) being fixedly provided on the fixing seat (110); a first spraying arm (120) rotatably connected to the fixing seat (110) in a direction around the fixing seat (110), and formed with a first spraying aperture (121); and a second spraying arm (140) rotatably connected to the first spraying arm (120). A second bevel gear (141) is provided at an end of the second spraying arm (140) near to the fixing seat (110), and is intermeshed with the first bevel gear (111); and a second spraying aperture (142) is provided in the second spraying arm (140). By providing the above spraying arm assembly (100), the cleaning efficiency of the dishwasher is increased effectively, and thus the product quality is improved.

7 Claims, 2 Drawing Sheets

(58) Field of Classification Search
USPC ..... 134/174, 179, 56 D, 57 D, 172, 180, 134/58 D; 239/227, 245, 251
See application file for complete search history.

(56) References Cited

U.S. PATENT DOCUMENTS

| | | | | |
|---|---|---|---|---|
| 8,113,222 | B2 * | 2/2012 | Bertsch | A47L 15/22 134/180 |
| 2006/0278258 | A1 * | 12/2006 | Kara | A47L 15/23 134/56 D |
| 2011/0146734 | A1 | 6/2011 | Rappette | |
| 2012/0279536 | A1 | 11/2012 | Adams et al. | |
| 2014/0069462 | A1 | 3/2014 | Becker et al. | |
| 2014/0299683 | A1 * | 10/2014 | Zhao | A47L 15/23 239/601 |
| 2015/0000708 | A1 | 1/2015 | Welch | |
| 2016/0198927 | A1 * | 7/2016 | Boyer | A47L 15/23 134/172 |
| 2016/0198928 | A1 * | 7/2016 | Xu | A47L 15/23 239/227 |

FOREIGN PATENT DOCUMENTS

| | | | | | |
|---|---|---|---|---|---|
| CN | 203709974 | U | | 7/2014 | |
| CN | 203789884 | U | | 8/2014 | |
| CN | 203987928 | | * | 12/2014 | A47L 15/22 |
| CN | 203987928 | U | | 12/2014 | |
| CN | 204158346 | U | * | 2/2015 | A47L 15/22 |
| CN | 204158346 | U | | 2/2015 | |
| CN | 104757921 | A | | 7/2015 | |
| CN | 204723008 | U | | 10/2015 | |
| EP | 2772176 | A1 | | 9/2014 | |
| WO | WO 2015049237 | A1 | | 4/2015 | |

OTHER PUBLICATIONS

Gao, Feng, "Spray Arm Unit and Dishwasher", Feb. 2015, CN 204158346—Machine Translation (Year: 2015).*
Foshan Shunde Midea Washing Appliances Mfg. Co. Ltd., First Office Action, CN201510194201.4, dated Jun. 3, 2016, 12 pgs.
Midea, International Search Report and Written Opinion, PCT/CN2016070045, dated Mar. 23, 2016, 22 pgs.

* cited by examiner

SPRAY ARM ASSEMBLY FOR DISHWASHER AND DISHWASHER HAVING SAME

PRIORITY CLAIM AND RELATED APPLICATION

This application is a continuation application of PCT/CN2016/070045, entitled "SPRAYING ARM ASSEMBLY FOR DISHWASHER AND DISHWASHER HAVING THE SAME" filed on Jan. 4, 2016, which claims priority to Chinese Patent Application No. 201510194201.4, filed with the State Intellectual Property Office of the People's Republic of China on Apr. 22, 2015, and entitled "SPRAYING ARM ASSEMBLY FOR DISHWASHER AND DISHWASHER HAVING THE SAME", and Chinese Patent Application No. 201520247198.3, filed with the State Intellectual Property Office of the People's Republic of China on Apr. 22, 2015, and entitled "SPRAYING ARM ASSEMBLY FOR DISHWASHER AND DISHWASHER HAVING THE SAME", all of which are incorporated herein by reference in their entirety.

TECHNICAL FIELD

The present disclosure relates to a field of manufacturing technology for electric washing appliances, and more particularly to a spray arm assembly for a dishwasher and a dishwasher having the same.

BACKGROUND

A dishwasher in the related art has a spray arm with a series of spray apertures, water at high pressure sprayed through the spray apertures can flush dishes to clean the dishes. In order to reduce water consumption, there are a limited number of spray apertures, and each spray aperture can only sprays water to one direction, resulting in a limited spraying area of the whole spray arm, and a lot of areas cannot be directly flushed, which means in order to achieve a cleaning effect, a long washing time is needed, reflection of a water flow and probability of reflection need improving. The spray arm of the dishwasher in the related art consumes a long washing time and has dead areas where dishes cannot be cleaned during the washing.

SUMMARY

Embodiments of the present disclosure seek to solve at least one of the problems existing in the related art to at least some extent. The present disclosure provides a spray arm assembly for a dishwasher, and the spray arm assembly has a simple structure and a good cleaning effect.

The present disclosure further provides a dishwasher having the above spray arm assembly.

According to a first aspect of embodiments of the present disclosure, the spray arm assembly is provided. The spray arm assembly includes a fixing seat, fixedly provided with a first bevel gear; a first spray arm, rotatably connected to the fixing seat in a circumferential direction of the fixing seat and defining a first spray aperture configured to drive the first spray arm to rotate; and a second spray arm, having an end adjacent to the fixing seat, the end of the second spray arm adjacent to the fixing seat being rotatably connected to the first spray arm and provided with a second bevel gear, the second bevel gear being engaged with the first bevel gear, and the second spray arm defining a second spray aperture.

For the spray arm assembly according to the embodiments of the present disclosure, the second spray arm can revolve about the fixing seat and rotate about its own axis through a configuration that the first spray arm capable of revolving about the fixing seat drives the second to revolve and the second bevel gear on the second spray arm 140 cooperates with the first bevel gear on the fixing seat. Accordingly, water can be sprayed out through the second spray aperture in different directions, thus enlarging a spraying area, increasing an area and probability of the dishes to be directly flushed, further speeding up the washing, avoiding presence of any dead area during the spraying and improving a cleaning rate of the dishwasher.

According to some embodiments of the present disclosure, the first spray arm is provided with a support arm, and the end of the second spray arm adjacent to the fixing seat is rotatably fitted on the support arm.

According to some embodiments of the present disclosure, a circumferential wall of the support arm is provided with a through hole in communication with the first spray arm and the second spray arm.

According to some embodiments of the present disclosure, the support arm has an end provided with a first hook, and an inner wall of the second spray arm is provided with a snap protrusion rotatably connected to the first hook though snapping.

According to some embodiments of the present disclosure, the first spray arm is provided with at least one second hook for snap connection with the second spray arm, a flange is provided to an outer circumferential surface of the end of the second spray arm adjacent to the fixing seat, and the flange is rotatably connected to the second hook through snapping.

According to some embodiments of the present disclosure, the fixing seat is provided with a fixing shaft, the first spray arm is provided with a connection tube, and the connection tube is rotatably fitted on the fixing shaft.

According to some embodiments of the present disclosure, an outer circumferential wall of the fixing shaft is provided with a position-limiting snap configured to prevent the connection tube from falling off, and the connection tube is rotatably arranged between the fixing seat and the position-limiting snap.

According to some embodiments of the present disclosure, an outer circumferential surface of the fixing shaft is provided with a restraining rib extending along an axis of the fixing shaft, the restraining rib has a guide bevel and a stop bevel, the guide bevel and the stop bevel are arranged at two opposite side surfaces along a circumferential direction of the fixing shaft and have different bevel angles, and an inner circumferential surface of the connection tube is formed with a restraining protrusion corresponding to the restraining rib.

According to some embodiments of the present disclosure, the fixing seat is provided with a water inlet channel in communication with the first spray arm and the second spray arm.

According to some embodiments of the present disclosure, a plurality of second spray apertures are provided along a length direction of the second spray arm and are spaced apart in a circumferential direction of the second spray arm.

According to some embodiments of the present disclosure, an axis of the second spray arm and an axis of the first spray arm coincide with each other or exhibit a preset angle, and one second spray arm is provided or a plurality of second spray arms with axes arranged at preset angles are provided.

According to some embodiments of the present disclosure, the first spray aperture is perpendicular to or at a preset inclined angle to a plane where the axis of the first spray arm and a revolution axis of the first spray arm are located.

According to a second aspect of embodiments of the present disclosure, the dishwasher is provided. The dishwasher includes an inner container; a spray arm assembly, arranged in the inner container and configured as the above spray arm assembly; a water conduit in communication with the first spray arm and the second spray arm of the spray arm assembly; and a water distributor, connected to the water conduit.

With the spray arm assembly configured as above, the dishwasher according to the embodiments of the present disclosure has improved cleaning efficiency and improved quality.

Figure 1:
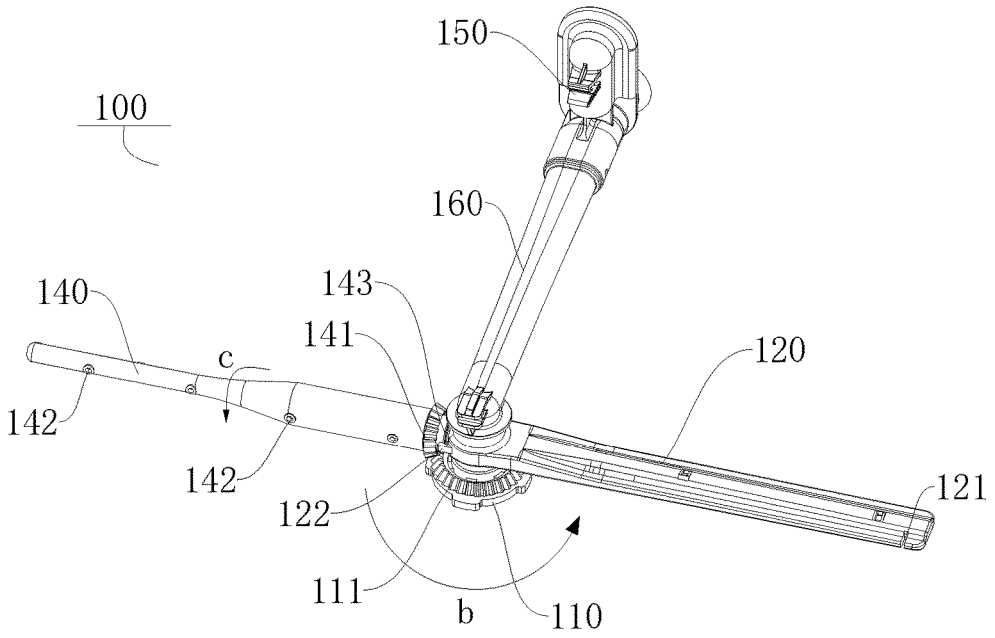
FIG. 1 is a perspective view of a spray arm assembly for a dishwasher according to an embodiment of the present disclosure.

REFERENCE NUMERALS spray arm assembly 100,
fixing seat 110, first bevel gear 111, fixing shaft 112, position-limiting snap 113,
restraining rib 114, guide bevel 1141, stop bevel 1142,
water inlet channel 115, water-running hole 116,
first spray arm 120, first spray aperture 121, second hook 122, connection tube 123,
support arm 130, first hook 131,
second spray arm 140, second bevel gear 141, second spray aperture 142, flange 143,
water distributor 150, water conduit 160.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

With reference to FIG. 1 to FIG. 4, a spray arm assembly 100 for a dishwasher according to embodiments of the present disclosure will be described in detail.

As illustrated in FIG. 1 to FIG. 4, the spray arm assembly 100 according to the embodiments of the present disclosure includes a fixing seat 110, a first spray arm 120 and a second spray arm 140.

Specifically, the fixing seat 110 is fixedly provided with a first bevel gear 111, and the first spray arm 120 is rotatably connected to the fixing seat 110 in a circumferential direction of the fixing seat 110. For example, the first spray arm 120 can revolve in a direction denoted by an arrow b shown in FIG. 1. The first spray arm 120 defines a first spray aperture 121 configured to drive the first spray arm 120 to rotate, and water sprayed through the first spray aperture 121 can drive the first spray arm 120 to rotate when water is sprayed out through the first spray aperture 121. The second spray arm 140 has an end adjacent to the fixing seat 110 and rotatably connected to the first spray arm 120, and the end of the second spray arm 140 adjacent to the fixing seat 110 is provided with a second bevel gear 141. The second bevel gear 141 is engaged with the first bevel gear 111. The second spray arm 140 defines a second spray aperture 142. When water is sprayed out through the first spray aperture 121, the first spray arm 120 revolves about the fixing seat 110, the first spray arm 120 drives the second spray arm 140 to revolve about the fixing seat 110 (as indicated by the arrow b in FIG. 1), and meanwhile, the second spray arm 140 can rotate around an axis thereof (as indicated by an arrow c in FIG. 1) under cooperation between the first bevel gear 111 and the second bevel gear 141. That is, when water is sprayed out through the first spray aperture 121, the second spray arm 140 revolves about the fixing seat 110 and meanwhile rotates about its own axis.

For the spray arm assembly 100 according to the embodiments of the present disclosure, the second spray arm 140 can revolve around the fixing seat 110 and meanwhile rotate about its own axis through a configuration that the first spray arm 120 capable of revolving about the fixing seat 110 drives the second spray arm 140 to revolve and the second bevel gear 141 on the second spray arm 140 cooperates with the first bevel gear 111 on the fixing seat 140. Accordingly, water can be sprayed out through the second spray aperture 142 in different directions, thus enlarging a spraying area, increasing an area and probability of the dishes to be directly flushed, further speeding up the washing, avoiding the presence of any dead area during the spraying and improving a cleaning rate of the dishwasher.

As illustrated in FIG. 1 to FIG. 4, according to an embodiment of the present disclosure, the first spray arm 120 is provided with a support arm 130, the end of the second spray arm 140 adjacent to the fixing seat 110 is rotatably fitted on the support arm 130. Thus, the second spray arm 140 can be conveniently mounted to the first spray arm 120. In an embodiment of the present disclosure, the support arm 130 can be in communication with a water conduit 160. Further, a circumferential wall of the support arm 130 may have a through hole (not shown in drawings) in communication with the first spray arm 120 and the second spray arm 140. Water can be conveniently fed to the first spray arm 120 and the second spray arm 140. The support arm 130 cannot only support the first spray arm 120, but also feed water to the first spray arm 120 and the second spray arm 140.

Figure 2:
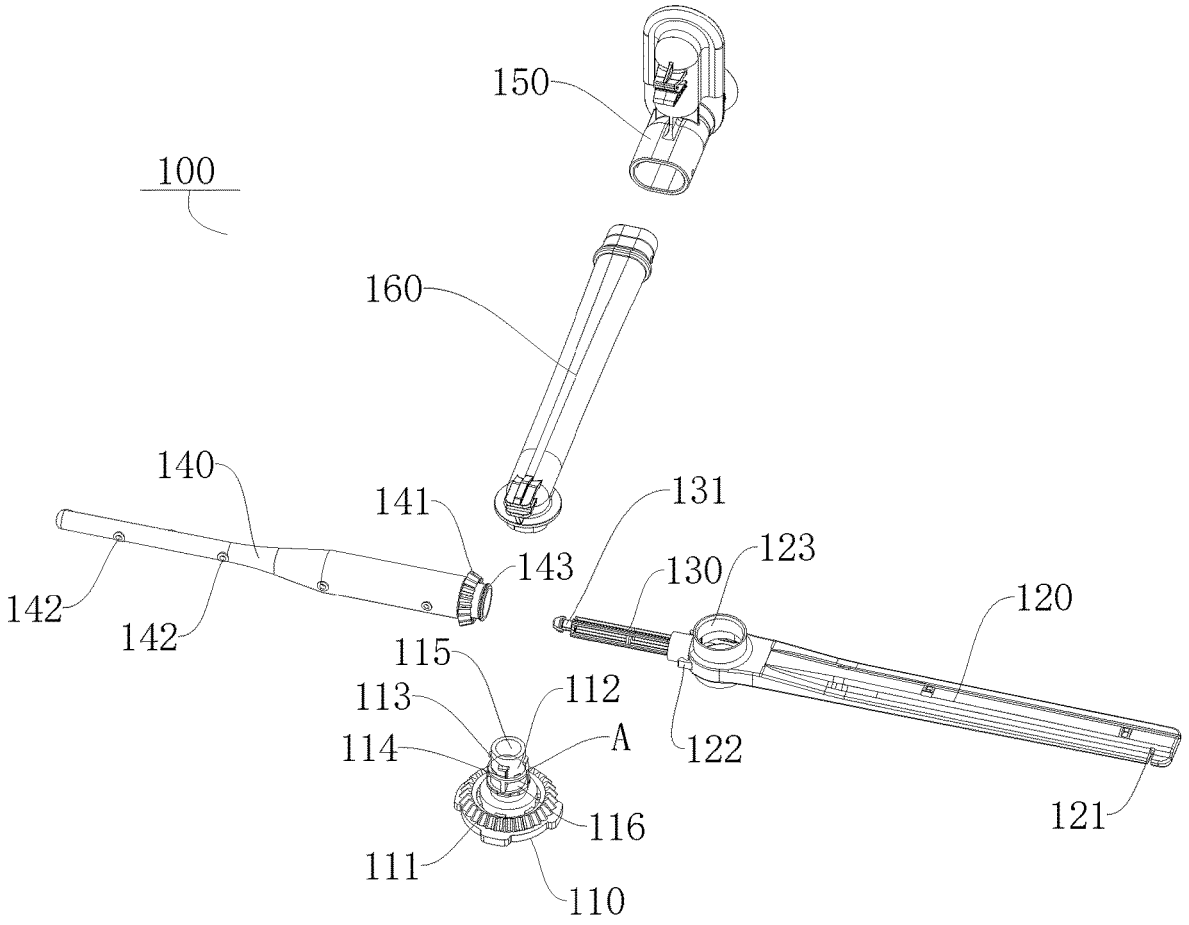
FIG. 2 is an exploded view of the spray arm assembly of FIG. 1.

As illustrated in FIG. 2, the support arm 130 has an end provided with a first hook 131, and an inner wall of the second spray arm 140 is provided with a snap protrusion (not shown) rotatably connected to the first hook though snapping, such that the second spray arm 140 can be conveniently mounted to the first spray arm 120. In an embodiment of the present disclosure, the first hook 131 can be configured as a resilient member, which facilitates mounting the second spray arm 140 to the first spray arm 120. Further, in order to improve reliability of connection between the first spray arm 120 and the second spray arm 140, the first spray arm 120 is provided with at least one second hook 122 for snap connection with the second spray arm 140, the end of the second spray arm 140 adjacent to the fixing seat 110 has an outer circumferential surface provided with a flange 143, and the flange 143 is rotatably connected to the second hook 122 through snapping. When the first spray arm 120 is provided with a plurality of (two or more than two) second hooks 122, the plurality of second hooks can be spaced apart along a circumferential direction of the first spray arm 120.

Figure 3:
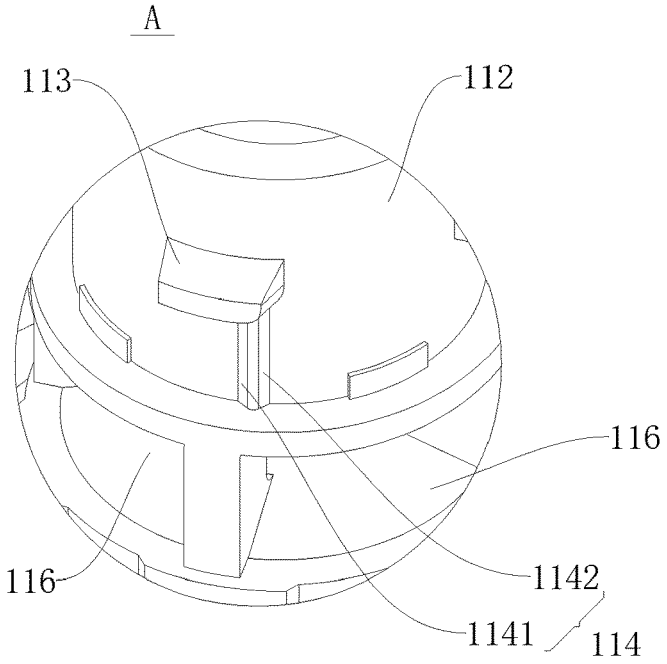
FIG. 3 is an enlarged view of part A of FIG. 2.

As illustrated in FIG. 2 and FIG. 3, the fixing seat 110 is provided with a fixing shaft 112, the first spray arm 120 is provided with a connection tube 123, and the connection tube 123 is rotatably fitted on the fixing shaft 112. It is convenient to mount the first spray arm 120 to the fixing seat 110. As illustrated in FIG. 2 and FIG. 3, an outer circumferential wall of the fixing shaft 112 is provided with a position-limiting snap 113 configured to prevent the connection tube 123 from falling off, and the connection tube 123 is rotatably arranged between the fixing seat 110 and the position-limiting snap 113.

As illustrated in FIG. 2 and FIG. 3, an outer circumferential surface of the fixing shaft 112 is provided with a restraining rib 114 extending along an axis of the fixing shaft 112. The restraining rib 114 has a guide bevel 1141 and a stop bevel 1142, and the guide bevel 1141 and a stop bevel 1142 are arranged at two opposite side surfaces along a circumferential direction of the fixing shaft 112 and have different bevel angles; an inner circumferential surface of the connection tube 123 is provided with a restraining protrusion (not shown in the drawings) corresponding to the restraining rib 114. When the restraining protrusion is fitted with the guide bevel 1141, the first spray arm 120 revolves about the fixing seat 110. When the restraining protrusion is fitted with the stop bevel 1142, the first spray arm 120 stops revolution. Movement of the first spray arm 120 can be effectively limited, such that the operational performance of the dishwasher can be improved. In an embodiment of the present disclosure, two restraining ribs may be provided and spaced apart along the circumferential direction of the fixing shaft 112, to make it convenient to limit or guide the movement of the first spray arm 120. One restraining protrusion can be provided to simplify a structure of the spray arm assembly 100.

As illustrated in FIG. 2 and FIG. 3, the fixing seat 110 is provided with a water inlet channel 115 in communication with the first spray arm 120 and the second spray arm 140, such that water can enter the first spray arm 120 and the second spray arm 140 from the water inlet channel 115. According to an embodiment of the present disclosure, the water inlet channel 115 has a water-running hole 116 in communication with the first spray arm 120 and the second spray arm 140, and a plurality of water-running hole 116 can be provided and spaced apart along a circumferential direction of the water inlet channel 115.

Figure 4:
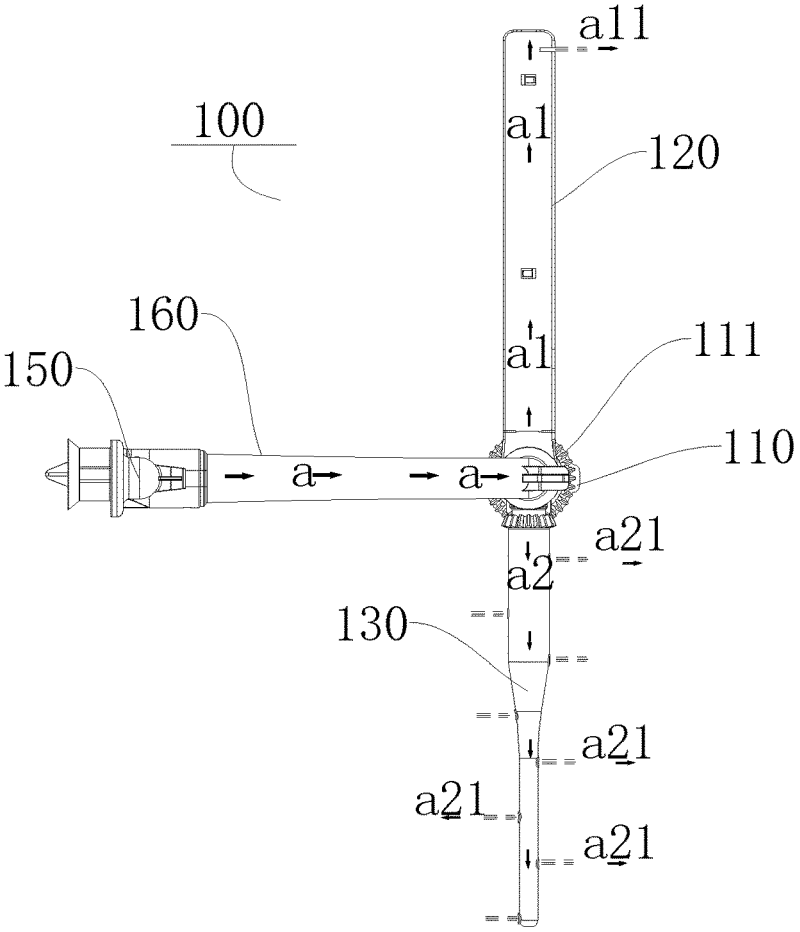
FIG. 4 is a schematic view of the spray arm assembly of FIG. 1.

In order to further enlarge the spraying area and accelerate a cleaning speed of the dishwasher, a plurality of second spray apertures 142 may be provided along a length direction of the second spray arm 140 and spaced apart along a circumferential direction of the second spray arm 140, as illustrated in FIG. 1, FIG. 2 and FIG. 4. Further, the axis of the second spray arm 140 and an axis of the first spray arm 120 can coincide with each other or exhibit a preset angle; and one second spray arm 140 can be provided, or a plurality of second spray arms 140 with axes arranged at preset angles can be provided, thus further enlarging the spraying area and accelerating the cleaning speed of the dishwasher. In an embodiment of the present disclosure, the first spray aperture 121 is perpendicular to or at a preset inclined angle to a plane where the axis of the first spray arm 120 and a revolution axis of the first spray arm 120 are located. The first spray aperture 121 can effectively drive the first spray arm 120 to rotate.

With reference to FIG. 4, a working process of the spray arm assembly 100 according to the embodiment of the present disclosure will be described in detail as follows. The water conduit 160 may be in communication with the support arm 130, so as to feed water to the first spray arm 120 and the second spray arm 140.

As illustrated in FIG. 4, water in the water conduit 160 flows along a direction denoted by an arrow a in FIG. 4, and enters the water inlet channel 115. The water in the water inlet channel 115 enters the first spray arm 120 (the water flowing in a direction denoted by an arrow a1 in FIG. 4) and the second spray arm 140 (the water flowing in a direction denoted by an arrow a2 in FIG. 4) separately through the water-running hole 116, and sprayed out from the first spray aperture 121 (the water flowing in a direction denoted by an arrow all in FIG. 4) and the second spray aperture 142 (the water flowing in a direction denoted by an arrow a21 in FIG. 4).

When water is sprayed out from the first spray aperture 121 (e.g. in the direction denoted by the arrow all in FIG. 4), the water which is sprayed out pushes the first spray arm 120 to revolve about the fixing seat 110 under a reaction force of the sprayed water, and the first spray arm 120 drives the second spray arm 140 to revolve about the fixing seat 110.

When the second spray arm 140 revolves about the fixing seat 110, the second bevel gear 141 on the second spray arm 140 engages with the first bevel gear 111 on the fixing seat 110 to drive the second spray arm 140 to rotate about its own axis.

The second spray arm 140 revolves about the fixing seat 110 and rotates about its own axis at the same time, and water in the second spray arm 140 is sprayed out through the second spray aperture 142 in the second spray arm 140. Water can be sprayed out in different directions, thus enlarging the spraying area, increasing the area and probability of the dishes to be directly flushed, further speeding up the washing, avoiding the presence of any dead area during the spraying, and improving the cleaning rate of the dishwasher.

As illustrated in FIG. 1 to FIG. 4, the dishwasher according to the present disclosure includes an inner container, a spray arm assembly 100, a water conduit 160 and a water distributor 150.

Specifically, the spray arm assembly 100 is configured as the above spray arm assembly 100, and the spray arm assembly 100 is arranged in the inner container. The water conduit 160 is in communication with the first spray arm 120 and the second spray arm 140 of the spray arm assembly 100. The water distributor 150 can be connected to the water conduit 160, and for example, as illustrated in FIG. 1 to FIG. 4, the water conduit 160 has a first end in communication with the water distributor 150 and a second end in communication with the support arm 130. In an embodiment of the present disclosure, the first end of the water conduit 160 can be connected to the water distributor 150 through snapping, and the second end of the water conduit 160 can be connected to the first spray arm 120 and the second spray arm 140 through snapping, thus facilitating the assembly and improving production efficiency.

For the dishwasher according to the embodiments of the present disclosure, the second spray arm 140 can revolve about the fixing seat 110 and meanwhile rotate about its own axis through the configuration that the first spray arm 120 capable of revolving about the fixing seat 110 drives the second spray arm 140 to revolve and the second bevel gear 141 on the second spray arm 140 cooperates with the first bevel gear 111 on the fixing seat 140. Accordingly, water can be sprayed out through the second spray aperture 142 in different directions, thus enlarging the spraying area, increasing the area and probability of the dishes to be directly flushed, further speeding up the washing, avoiding the presence of any dead area during the spraying, and improving the cleaning rate of the dishwasher.

In the specification, it is to be understood that terms such as "central," "upper," "lower," "vertical," "horizontal," "top," "bottom," "inner," "outer," "axial," "radial," and "circumferential" should be construed to refer to the orientation as then described or as shown in the drawings under discussion. These relative terms are for convenience of description and do not require that the present invention be constructed or operated in a particular orientation. Terms used herein should not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, the term "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Reference throughout this specification to "an embodiment," "some embodiments," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A spray arm assembly for a dishwasher, comprising:

a fixing seat, fixedly provided with a first bevel gear and a fixing shaft;

a first spray arm having a connection tube, rotatably connected to the fixing seat by fitting the connection tube on the fixing shaft, and defining a first spray aperture configured to drive the first spray arm to rotate in a circumferential direction of the fixing seat; and a second spray arm, having an end adjacent to the fixing seat, the end of the second spray arm adjacent to the fixing seat being rotatably connected to the first spray arm and provided with a second bevel gear, the second bevel gear being engaged with the first bevel gear, and the second spray arm defining one or more second spray apertures, wherein the fixing shaft includes a water inlet channel that has an inlet end configured to communicate with a water conduit of the dishwasher and a water-running hole below the inlet end, the water-running hole is configured to communicate with the first spray arm within the connection tube of the first spray arm, and wherein the first bevel gear is provided below the water-running hole in the fixing shaft.

2. The spray arm assembly according to claim 1, wherein the first spray arm is provided with a support arm, and the end of the second spray arm adjacent to the fixing seat is rotatably fitted on the support arm.

3. The spray arm assembly according to claim 1, wherein the first spray arm is provided with at least one second hook for snap connection with the second spray arm, the end of the second spray arm adjacent to the fixing seat is provided with a flange at its outer circumferential surface that is rotatably connected to the at least one second hook through snapping.

4. The spray arm assembly according to claim 1, wherein an outer circumferential wall of the fixing shaft is provided with a position-limiting snap configured to prevent the connection tube from falling off, and the connection tube is rotatably arranged between the fixing seat and the position-limiting snap.

5. The spray arm assembly according to claim 1, wherein an outer circumferential surface of the fixing shaft is provided with a restraining rib extending along an axis of the fixing shaft, the restraining rib has a guide bevel and a stop bevel, the guide bevel and the stop bevel are arranged at two opposite side surfaces along a circumferential direction of the fixing shaft and have different bevel angles, and an inner circumferential surface of the connection tube is formed with a restraining protrusion corresponding to the restraining rib.

6. The spray arm assembly according to claim 1, wherein the fixing seat is provided with a water inlet channel in communication with the first spray arm and the second spray arm.

7. The spray arm assembly according to claim 1, wherein the first spray aperture is perpendicular to or at a preset inclined angle to a plane where a rotation axis of the first spray arm and a revolution axis of the second spray arm are located.

* * * * *